United States Patent [19]

Bergström

[11] 4,056,072

[45] Nov. 1, 1977

[54] SYSTEM FOR TRIMMING THE MAST OF A SAILING YACHT

[76] Inventor: Lars Rune Bergström, Lands End, Longboat Key, Fla. 33548

[21] Appl. No.: 718,777

[22] Filed: Aug. 30, 1976

[51] Int. Cl.[2] ..... B63B 15/02

[52] U.S. Cl. ..... 114/109; 114/91

[58] Field of Search ..... 114/89, 90, 91, 102, 114/143, 39, 109, 150

[56] References Cited

U.S. PATENT DOCUMENTS

| | | | |
|---|---|---|---|
| 2,261,444 | 11/1941 | Neubert, Jr. | 114/150 |
| 3,099,976 | 8/1963 | Schwaneke et al. | 114/91 |
| 3,620,182 | 11/1971 | Russell | 114/109 |
| 3,658,297 | 4/1972 | Banks, Jr. | 114/109 |
| 3,903,827 | 9/1975 | Marcil | 114/91 |

*Primary Examiner*—Trygve M. Blix
*Assistant Examiner*—Stuart M. Goldstein
*Attorney, Agent, or Firm*—William E. Mouzavires

[57] ABSTRACT

A system for trimming the mast of a sailing yacht wherein the fore and aft stays of the mast are fixed to the top of the mast and extend downwardly to the hull to which they are connected by means of hydraulic cylinders, including pistons respectively connected to the stays. Trimming of the mast is achieved by simultaneously moving the stays to adjust or trim the position of the top of the mast through means of a control cylinder having a control piston which, when moved, admits hydraulic fluid into one of the stay cylinders to in effect shorten the associated stay while, at the same time, removing hydraulic fluid from the other stay cylinder to in effect lengthen the associated stay. Once the desired trim is achieved, the control piston is locked in the adjusted position. A pump and an associated hydraulic fluid supply is provided for the system together with a selector valve for connecting the fluid supply to either end of the control cylinder.

5 Claims, 2 Drawing Figures

SYSTEM FOR TRIMMING THE MAST OF A SAILING YACHT

BACKGROUND OF INVENTION

It is well-known that by trimming a mast in the fore or aft direction, the lever arm of the moment which causes heeling can be decreased to overcome the tendency of the sailboat to sail into the wind. This becomes particularly important when sailing in heavy winds where the rudder is relied upon to resist heeling and the tendency of the sailboat to sail into the wind.

According to one known method of trimming a mast which utilizes hydraulic cylinders to connect the fore and aft stays to the hull, trimming is achieved in two steps by trial and error through releasing the tension in one stay by discharging hydraulic fluid from the associated cylinder, and by increasing the tension in the other stay by supplying the associated hydraulic cylinder with hydraulic fluid. With this method, it is difficult to achieve the desired tension in the stays because the hydraulic cylinders are supplied and exhausted independently of each other in a two step operation. Moreover, during such trial and error adjustment, the shape of the sail undergoes change providing less windward performance and impaired sailing efficiency. This is particularly significant in racing.

OBJECTS OF THE PRESENT INVENTION

It is an object of the present invention to provide an improved system and method for trimming the mast of a sailboat or sailing yacht in a controlled and accurate manner and which will not materially affect the sail shape or reduce sailing efficiency during actual sailing. Included herein is such a system and method which may also be used to initially set the tension in the rigging of a sailboat and which permits the same tension to be maintained.

A further object of the present invention is to provide novel and improved method and apparatus for trimming the mast of a sailboat or yacht in a relatively quick and simple manner requiring no special expertise or complicated equipment. Included herein is such method and apparatus which may be implemented by the use of readily available hydraulic components and which may be applied to new, old or conventional sailboats or yachts.

DRAWINGS

Other objects and advantages of the present invention will become apparent from the following more detailed description taken in conjunction with the attached drawings in which:

FIG. 1 is a schematic view of a sailing yacht having provision for trimming a mast in accordance with known or conventional methods; and FIG. 2 is a side elevational view of a sailing yacht incorporating the novel and improved system of the present invention.

DETAILED DESCRIPTION

Figure 1:
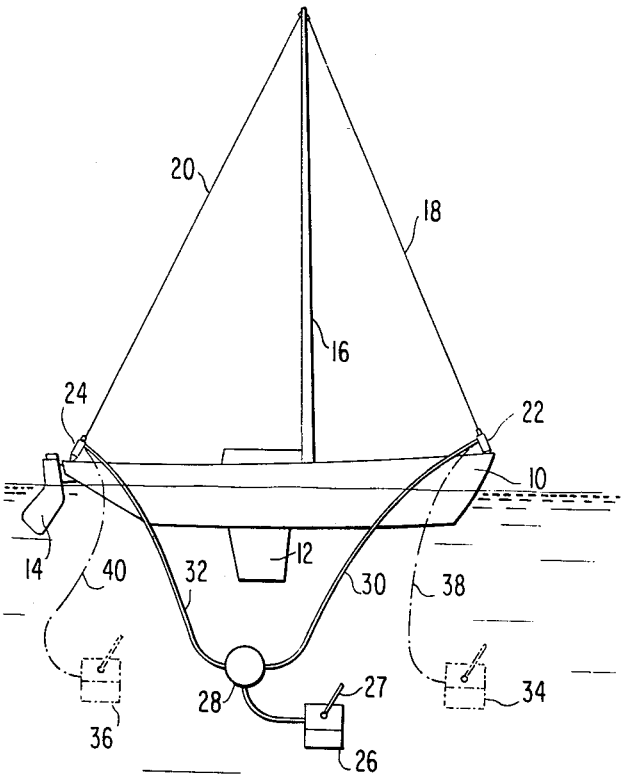
FIG. 1 PRIOR ART

Referring now to the drawings and initially FIG. 1, there is shown a sailing yacht or sailboat including a system for trimming the mast in accordance with known prior methods. The shown yacht typically includes a hull 10 having a keel 12 and a rudder 14. Upstanding from the hull is a conventional mast 16 including a forestay 18 and an aftstay 20 fixed to the top of the mast 16. Stays 18 and 20 are connected to the hull by means of hydraulic rams or cylinders 22 and 24, respectively, which include pistons connected to the stays 18 and 20 so that movement of the pistons (not shown) will cause corresponding increase or decrease in the length of stays 18 and 20 to adjust the tension therein. When it is desired to trim the mast 16 forwardly, for example, utilizing this prior known method, hydraulic fluid is introduced into cylinder 22 to decrease the length of the associated stay 18 to apply tension to the mast which would cause it to move at the upper end in the forward direction. However, because of the fact that prior to trim adjustment the stays 18 and 20 are under substantial maximum tension as is conventional, it is necessary to first release the tension in the other stay 20. This is done by discharging hydraulic fluid from the associated cylinder 24.

To supply and exhaust hydraulic fluid to and from cylinders 22 and 24, a pump 27 which may be operated by hand and include an associated reservoir 26 for hydraulic fluid may be utilized. Also, a selector valve 28 may be used to place one or the other of hydraulic lines 30 and 32 in communication with reservoir 26. With this system, selector valve 28 must first be positioned to exhaust hydraulic fluid from one of the cylinders 22 or 24 and decrease the tension in the associated stay. Thereafter, selector valve 28 is moved to introduce hydraulic fluid into the other hydraulic cylinder 22 or 24 to increase the tension of the associated stay.

The problem with the aforementioned system is that it requires trial and error and it is difficult to obtain a precise adjustment since the decrease of tension in one of the stays 18 or 20 and the increase of tension in the other stay are done independently of each other. Moreover, if the trim adjustment is made during sailing, the trial and error method often causes loss of sail shape, decreasing the sail efficiency and the performance of the boat. In a race, this can be crucial.

Instead of utilizing a single reservoir 26 and pump 27 in conjunction with a selector valve 28 as described above, other prior systems have utilized separate reservoirs and pump units 34 and 36 (shown in dotted lines in FIG. 1) in conjunction with the hydraulic rams 22 and 24 which are connected to the former by hydraulic lines 38 and 40 (shown in dotted lines in FIG. 1).

The problem with these prior systems is that to obtain the proper trim adjustment, one of the stays must first be released or decreased in tension prior to the application of tension on the other stay. This is a two step process requiring independent operation of the hand pumps 34 and 36 in the one embodiment or the single pump 27 in the other embodiment which is effected in two stages: one being when the selector valve 28 is in one position connecting one of the lines 30 or 32 to the reservoir 26 and the other stage being when the selector valve is in the opposite position connecting the other line 30 or 32 with reservoir 26. It can be readily seen that these prior methods require trial and error to arrive at the proper trim adjustment, and accordingly, the proper trim adjustment is difficult to achieve, if at all. Moreover, because at the outset stays 18 and 20 are at their maximum tension, these prior methods require that one of the stays be decreased in tension before the other stay can be increased in tension to provide the trim adjustment. This causes loss of sail shape and decreased sail efficiency which obviously can adversely affect performance of the sailboat. Furthermore, this upsets the original set tension of the rigging system.

FIG. 2 — THE PRESENT INVENTION

Figure 2:
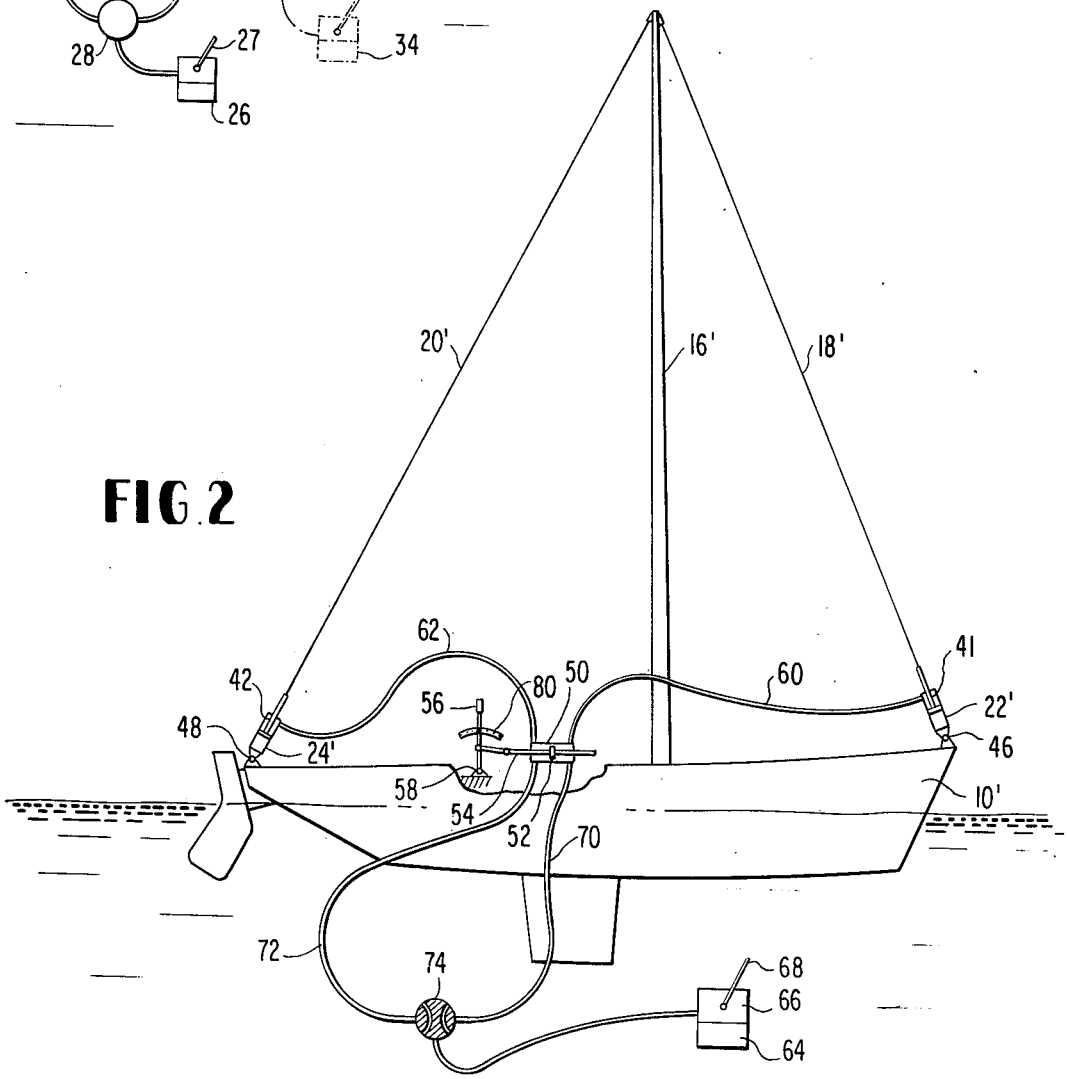

Referring now to FIG. 2, the problems noted above in connection with prior systems are uniquely overcome by the present invention which is shown as being applied to a sailboat of the same basic character described above in connection with FIG. 1. That is to say, that the stays 18' and 20' of the FIG. 2 embodiment are fixed at their upper ends to the top of mast 16'. The lower ends of stays 18' and 20' are respectively connected to pistons 41 and 42 of hydraulic rams 22' and 24' which are anchored at 46 and 48 to the fore and aft portions of the hull 10' similar to the system described above in connection with FIG. 1.

However, in accordance with the present invention, a novel control means in the form of a hydraulic ram or cylinder 50 is provided for supplying and exhausting the fluid from the ends of hydraulic rams 22' and 24'. Control cylinder 50 includes a control piston 52 having a piston rod 54 which, in the specific embodiment, is connected to a manual handle 56 which, in turn, is pivoted at 58 relative to the hull so as to be movable in a vertical plane to move control piston rod 54 to change the position of piston 52 in control cylinder 50. The latter in turn will supply hydraulic fluid to one of the rams 22' or 24' while exhausting fluid from the other ram 22' or 24'.

The opposite ends of control cylinder 50 are respectively connected to the ends of hydraulic rams 22' and 24' by means of hydraulic lines 60 and 62. In the specific embodiment, the opposite ends of control cylinder 50 are also adapted to be connected alternatively to a hydraulic reservoir 64 which is associated as a unit with a pump 66 having a manual operating handle 68. This latter connection is achieved through lines 70 and 72 communicating with the opposite ends of cylinder 50 and a selector valve 74 which, although shown in closed position in FIG. 2, is capable of moving to two alternate or opposite positions. In one of these latter positions, the selector valve communicates one of the two lines 70 or 72 with reservoir 64 while blocking communication of the other of lines 70 or 72 with the reservoir. In the opposite position of the selector valve, the reverse situation is achieved.

During initial rigging of the boat, such as before commencing sailing, the same amount of hydraulic fluid is placed on one side of rams 22' and 24' and with the control piston 52 positioned approximately in the center of control cylinder 50 with the same amount of hydraulic fluid in control cylinder 50 on opposite sides of control piston 52. In this way, the initial tension in stays 18' and 20' is achieved and such tension is usually set close to the maximum, for example, in a typical one-quarter tonner sailboat which is a very common class, the tension in stays 18' and 20' is approximately two thousand (2,000) pounds. Once this tension is achieved at the outset as mentioned, selector valve 74 is turned to the closed position shown in FIG. 2, thus blocking communication between lines 70 and 72 and reservoir 64.

If during sailing such as in a race, it is desired to trim the mast, for example, rearwardly in the aft direction, the operator moves control piston 52 to the left (as viewed in FIG. 2) by means of pivoting handle 56 counterclockwise. This causes additional hydraulic fluid to enter into the aft hydraulic ram 24' to move piston 42 downwardly to shorten the distance between the top of mast 16' and aft anchor 48. This may be termed "shortening the aftstay", although it is noted that the absolute length of the stay is always the same. Simultaneously with the latter, hydraulic fluid is caused to leave the fore hydraulic ram 22' and return to the right-hand (as viewed in FIG. 2) end of control cylinder 50, this increasing the distance between fore anchor 46 and the top of mast 16 to compensate for the decrease in length between the top of mast 16 and aft anchor 48 which was just described. The net effect is to move the top of mast 16 in the aft direction to achieve the desired trim. Since this trim is achieved by one control movement of control piston 52, a highly accurate trim adjustment of the mast is achieved. Moreover, since the adjustment in the effective lengths of the fore and aft stays is achieved simultaneously, loss of sail shape or decreased sail efficiency or performance is uniquely avoided and furthermore, the original tension (2,000 pounds) which was set in the rigging system is maintained during the trim adjustment.

Should it be desired to trim the mast forwardly or in the fore direction, movement of the control piston 52 in the direction reverse or opposite to that described above is effected. That is, control piston 52 is moved to the right as viewed in FIG. 2 by means of pivoting control handle 56 counterclockwise. This causes additional hydraulic fluid to enter into fore hydraulic ram 22' associated with forestay 18' thereby decreasing the effective length of forestay 18' and increasing the effective length of aftstay 20', the latter being achieved by hydraulic fluid leaving the aft hydraulic ram 24' and returning to the control cylinder 50 on the left-hand side of control piston 52.

Once the desired trim adjustment is achieved, it is important that the control piston 52 be locked in the adjusted position against movement to maintain the desired trim adjustment. A suitable lock mechanism, latch or detent may be provided for this purpose. In the specific embodiment shown, a latch mechanism generally designated 80 is used to releasably retain handle 56 in the desired adjusted position. Any conventional lock, latch or detent mechanism may be employed and therefore further description of the details thereof is not necessary. In addition, and although not shown, indicia may be provided adjacent handle 56 such as on the detent mechanism 80 to indicate the adjusted positions of the control piston 52. Detent or lock mechanism 80 is also employed to lock the control piston 52 in position at the outset during initial rigging described above prior to actual sailing.

It will thus be seen that the present invention not only provides a unique method of accurately obtaining the desired trim of the mast without sacrificing performance of the sailboat, but also the present invention may be utilized during the initial rigging system to set the desired tension in the fore and aft stays. It is further noted that the initial set tension in the stays remains the same throughout the trim adjustment. The only factor which varies is the effective distance between the top of the mast 16 and the anchor points of the fore and aft stays.

It should be understood that although a manual operating means, in the form of handle 56, has been shown and described for operating control piston 52, it will be appreciated that a motor or other power means may be utilized to effect such movement. Also in the preferred embodiment, a lock or detent mechanism, such as 80, is employed to lock the control handle 56 in position, but the handle may be positively held in position by the operator although it is preferred that a positive lock or detent mechanism be employed to relieve the necessity of the operator to hold the handle.

What is claimed is:

1. In a sailboat having a hull, a mast projecting upwardly from the hull, a forestay fixed to the top of the mast, an aftstay fixed to the top of the mast, a first hydraulic cylinder connected to the hull at a forward location thereof and including a piston connected to the forestay, a second hydraulic cylinder connected to an aft portion of the hull and including a piston connected to the aftstay, the improvement comprising control means simultaneously supplying one of said hydraulic cylinders with fluid while exhausting the other hydraulic cylinder of fluid for moving the fore and aft stays simultaneously to trim the mast in either the fore or aft direction as desired, and wherein said control means includes a hydraulic control cylinder and first and second hydraulic fluid lines respectively interconnecting the opposite ends of the hydraulic control cylinder and said first and second hydraulic cylinders, and wherein said control cylinder includes a control piston, and wherein there is further included drive means for moving the control piston in the control cylinder for supplying and exhausting hydraulic fluid from said first and second hydraulic cylinders simultaneously, and wherein there is further included a hydraulic fluid reservoir, third and fourth hydraulic lines communicating with the control cylinder on opposite sides of said control piston and means for selectively communicating said third and fourth hydraulic fluid lines with the reservoir.

2. The combination defined in claim 1 further including releasable lock means for maintaining said control piston in fixed position against movement in the control cylinder.

3. The combination defined in claim 2 wherein said drive means includes a manually operable member connected to said control piston and wherein said lock means is releasably engageable with said manually operable member.

4. The combination defined in claim 1 wherein said last defined means includes a selector valve.

5. The combination defined in claim 3 wherein said means for selectively communicating said third and fourth hydraulic fluid lines with the reservoir includes a selector valve.

* * * * *